United States Patent [19]

Grilliot et al.

[11] Patent Number: 4,782,534

[45] Date of Patent: Nov. 8, 1988

[54] FIREFIGHTER'S GARMENT HAVING DOUBLE WRISTLET SLEEVE AND CUFF

[76] Inventors: William L. Grilliot; Mary I. Grilliot, both of 1986 Home Ave., Dayton, Ohio 45417

[21] Appl. No.: 153,353

[22] Filed: Feb. 8, 1988

[51] Int. Cl.[4] ..... A41D 1/02; A41D 3/02

[52] U.S. Cl. ..... 2/81; 2/270

[58] Field of Search ..... 2/81, 82, 93, 97, 272, 2/270

[56] References Cited

U.S. PATENT DOCUMENTS

| | | | |
|---|---|---|---|
| 3,525,334 | 8/1970 | Braman | 2/81 |
| 4,543,670 | 10/1985 | Ehring | 2/270 X |
| 4,631,753 | 12/1986 | Ehring | 2/270 X |
| 4,729,130 | 3/1988 | Grilliot et al. | 2/81 |

*Primary Examiner*—H. Hampton Hunter

*Attorney, Agent, or Firm*—Jacox & Meckstroth

[57] ABSTRACT

A firefighter's garment having a double wristlet sleeve and cuff structure. The garment has full length sleeves. The garment, including the sleeves, has a plurality of layers: an outer layer, which is a flame resistant layer, an intermediate layer, which is a moisture barrier layer, and an inner layer, which is a thermal barrier layer. A cuff member of moisture barrier material is positioned at the end portion of each sleeve and extends directly from at least one of the layers. A wristlet or seal member is encompassed by the cuff member and is adapted to snugly encompass the wrist of the firefighter who wears the garment. Another wristlet or seal member is positioned between the cuff member and the outer layer. The wristlets or seal members are preferably of thermal barrier material. Thus, the sleeve and cuff structure protects the firefighter against movement of fluids and hot embers and other debris to the wrist and arm of the firefighter.

27 Claims, 1 Drawing Sheet

FIREFIGHTER'S GARMENT HAVING DOUBLE WRISTLET SLEEVE AND CUFF

BACKGROUND OF THE INVENTION

A firefighter's garment, such as a coat or jacket, customarily has a pair of arm length sleeves. It is desirable that each sleeve terminate with a cuff that protects the wrist portion and arm portion of the firefighter.

A firefighter's garment customarily has three layers of material, including: an outer shell, which is flame resistant, an intermediate layer which is a moisture barrier and an inner layer which is a thermal barrier. These layers may be three distinct layers or one or two members.

Problems have existed in regard to the sleeve and cuff portions of a firefighter's garment. It is desirable to have a cuff portion which closely encompasses the wrist of the firefighter who wears the garment. It is desirable that the cuff portion prevent the flow of water into the sleeve and to the arm. It is also desirable that the cuff portion prevent the movement of hot embers and debris into the sleeve and to the arm.

Known sleeve and cuff structures in a firefighter's garment which are capable of preventing flow of water to the sleeve and to the arm of the firefighter are not capable of effectively preventing movement of hot embers or debris or the like into the sleeve and to the arm of the firefighter. Also, known firefighter's garments which are capable of preventing movement of hot embers or debris or the like into the sleeve and to the arm of the firefighter are not capable of effectively preventing entrance of water into the sleeve and to the arm of the firefighter.

An object of this invention is to provide a firefighter's garment which includes a sleeve and cuff structure which prevents flow of water into the sleeve and/or to the arm of the firefighter.

Another object of this invention is to provide such a sleeve and cuff structure in a firefighter's garment which also prevents movement of hot embers and debris and the like into the sleeve and/or to the arm of the firefighter.

Another object of this invention is to provide a firefighter's garment which includes a sleeve and cuff structure which has a plurality of layers and in which the sleeve portion of the outer layer can be detached from the other layers for drying and the like.

Another object of this invention is to provide such a firefighter's garment which includes a sleeve and cuff structure which has a plurality of layers and in which the outer layer can be removed from the other layers for cleaning and the like.

Other objects and advantages of the firefighter's garment of this invention reside in the construction of parts, the combination thereof, the method of production and the mode of use, as will become more apparent from the following description.

SUMMARY OF THE INVENTION

This invention provides a firefighter's garment which includes a double wristlet or double seal sleeve and cuff structure. The firefighter's garment of this invention includes an outer layer or outer shell, which is flame resistant. The garment also has an intermediate layer which is a moisture barrier. The garment also has an inner layer which is a thermal barrier. The garment has a pair of full length sleeves and each sleeve includes the three layers.

Each of the layers in the sleeve extends substantially the length of the sleeve. An annular cuff member which is of moisture barrier material extends from the intermediate layer and may be considered a part of or an extension of the intermediate layer. An annular wristlet or seal member is joined to the outer surface of the inner layer. This wristlet may be considered a part of or an extension of the inner layer. This annular wristlet or seal member is adapted to closely encompass and engage the wrist portion of the firefighter and is adapted to seal between the wrist of the firefighter and the intermediate layer. Another annular wristlet or seal member is attached to the inner surface of the outer layer. This wristlet may be considered a part of or an extension of the outer layer. This wristlet engages the cuff member and is adapted to seal between the outer layer and the cuff member. The wristlets or seal members are preferably, but not necessarily, of thermal barrier material.

Thus, the cuff portion and the seal members of each sleeve of the garment seal against movement of both water and debris to the arm of the firefighter.

DETAILED DESCRIPTION OF THE INVENTION

Figure 1:
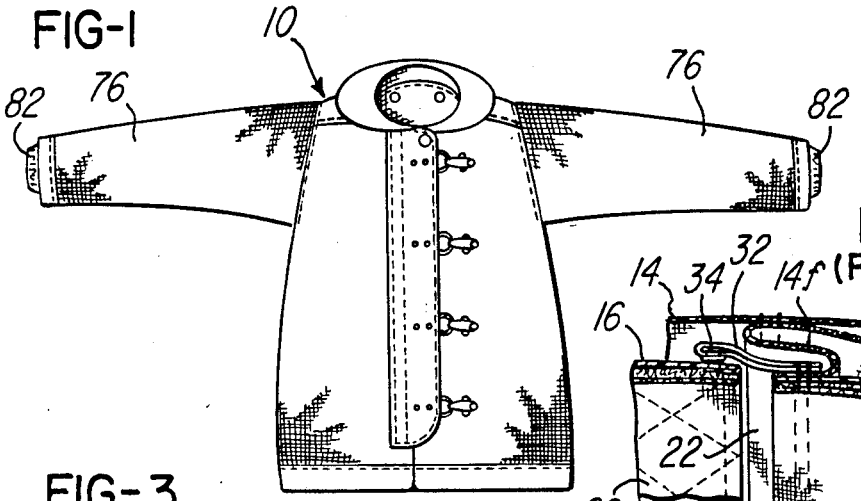
FIG. 1 is a front plan view of a firefighter's garment which has sleeve and cuff structure in accordance with this invention.

FIG. 1 illustrates generally a firefighter's garment 10 which includes sleeve and cuff structure of this invention.

Figure 2:
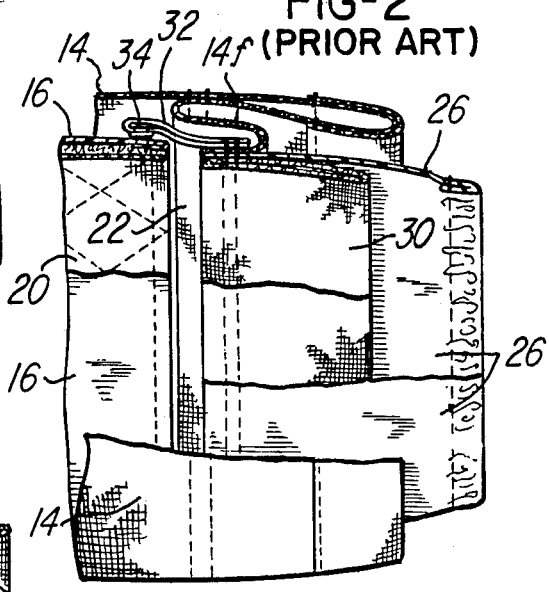
FIG-2 (PRIOR ART)
FIG. 2 is a fragmentary sectional view, with parts broken away, drawn on a much larger scale than FIG. 1, showing a sleeve and cuff structure of a prior art garment.

FIG. 2 illustrates a prior art sleeve and cuff structure in a firefighter's garment. FIG. 2 shows a sleeve having an outer layer or shell 14, an intermediate layer or moisture barrier 16, and an inner layer or thermal barrier 20. At the end of the sleeve is a cuff member 26. A space 22 separates the intermediate layer 16 from the cuff member 26. The cuff member 26 is of moisture barrier material and is intended to serve as an extension of the moisture barrier layer 16. However, the extension is separated by the space 22. Encompassed by the cuff member 26 and attached thereto is a sealing member in the form of a wristlet 30, which is of thermal barrier material.

The cuff member 26 is attached to the outer shell 14 by a folded portion **14*f* of the outer shell 14. The cuff member 26 is joined to the intermediate layer 16 by tie members 32, which are shown secured to the cuff member 26 and attached by snap members 34 to the intermediate layer 16**.

Due to the fact that the cuff member 26, shown in FIG. 2, tightly encompasses the wrist of the firefighter, the cuff member 26 seals against flow of water directly to the wrist and arm of the firefighter. Due to the fact that the wristlet 30 tightly encompasses the wrist of the firefighter, the wristlet 30 seals against movement of debris and embers and the like to the wrist and arm of the firefighter.

However, the outer layer or shell 14 is not a moisture barrier. Therefore, water and other firefighting fluids penetrate the outer layer 14 and engage the intermediate layer 16. The intermediate layer 16 is a moisture barrier and cover the arm of the firefighter. The water or other fluids travel along outer surface of the intermediate layer 16 and flow through the space 22 and engage the wrist and arm of the firefighter. Thus, this prior art structure shown in FIG. 2 has objectionaable features.

Figure 3:
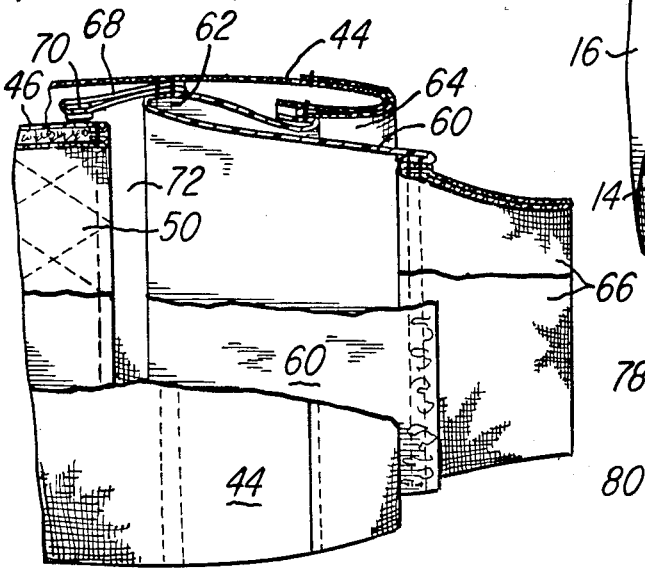
FIG-3 (PRIOR ART)
FIG. 3 is a fragmentary sectional view, with parts broken away, drawn on substantially the same scale as FIG. 2, showing a sleeve and cuff structure of another prior art garment.

FIG. 3 illustrates another prior art sleeve and cuff structure in a firefighter's garment. The structure of FIG. 3 includes a sleeve having an outer layer or protective barrier 44, an intermediate layer or moisture barrier 46, and an inner layer or thermal barrier 50. A cuff member 60, of moisture barrier material is encompassed by the outer layer 44. The cuff member 60 is attached to the inner surface of the outer layer 44 by an annular connection portion 62 and an annular connection portion 64. A wristlet 66 is attached to the end of the cuff member 60. The wristlet 66 is constructed of thermal barrier material and tightly encompasses the wrist of the firefighter. The cuff member 60 is joined to the intermediate layer 46 by tie members 68 which are secured to the cuff member 60 and are attached by snaps 70 to the intermediate layer 46. As shown in FIG. 3, there is a gap or space 72 between the intermediate layer 46 and the cuff member 60.

Thus, the sleeve and cuff structure of FIG. 3 provides limited protection to the wrist and arm of the firefighter. The outer layer 44 is not a moisture barrier. Therefore, water and other firefighting fluids penetrate the outer layer 44 and engage the outer surface of the intermediate layer 46. The gap or space 72 between the intermediate layer 46 and the cuff member 60 permits fluids to flow therethrough, and into engagement with the wrist and arm of the firefighter. Therefore, the structure of FIG. 3 has objectionable features.

Figure 4:
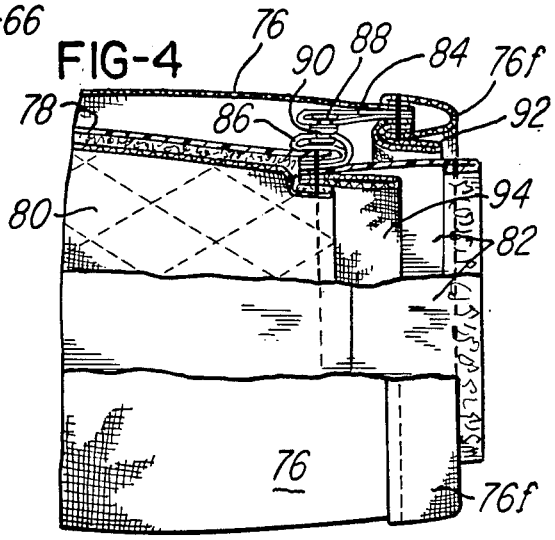
FIG. 4 is a fragmentary sectional view, with parts broken away, drawn on substantially the same scale as FIGS. 2 and 3, and showing sleeve and cuff structure of this invention.
Figure 5:
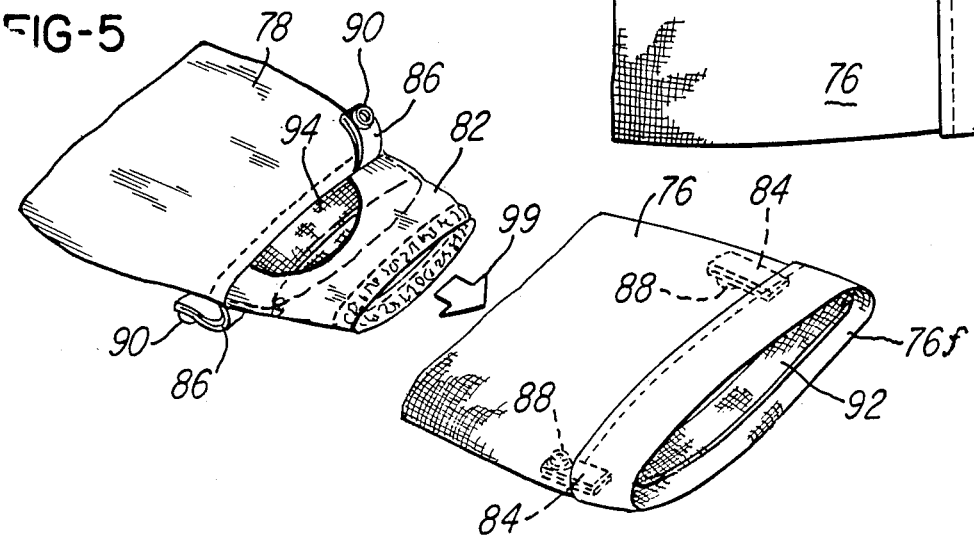
FIG. 5 is a perspective exploded view, drawn on a smaller scale than FIGS. 2, 3 and 4, showing the sleeve and cuff structure of FIG. 4.

FIGS. 4 and 5

FIGS. 4 and 5 illustrate sleeve and cuff structure of this invention. The structure comprises a sleeve which includes an outer shell or outer layer 76 of flame resistant material. The extremity portion of the outer layer is shown as having a fold portion **76*f* which is folded back on itself. The sleeve also includes an intermediate layer or moisture barrier 78 and an inner layer or thermal barrier 80. Attached to the intermediate layer 78 by means of stitching or the like, and extending directly therefrom is an annular cuff member 82 which is of moisture barrier material. The cuff member 82 is shown as also extending from the inner layer or thermal barrier 80** and attached thereto.

A plurality of tabs 84 is attached to the inner surface of the outer layer 76. A plurality of tabs 86 is attached to the outer surface of the intermediate layer 78. Secured to the tabs 84 are snaps 88, and secured to the tabs 86 are complementary snaps 90. The tabs 84 are releasably attached to the tabs 86 by means of the snaps 88 and 90.

Attached to the fold portion **76*f* at the inner surface of the outer layer 76 is an annular wristlet or seal member 92, which is of thermal barrier material. The wristlet 92 may be of any suitable thermal barrier material such as, for example, a material known as NOMEX sold by DuPont Company. However, the wristlet 92 may be of any other suitable seal material. The wristlet 92 snugly encompasses the cuff member 82**.

Attached to a position between the cuff member 82 and the inner layer 80 and extending from the inner layer 80 is an annular wristlet or seal member 94 which is, preferably, thermal barrier material. The wristlet or seal member 94 is adapted to tightly encompass the wrist of the firefighter.

The cuff member 82 is also adapted to tightly encompass the wrist of the firefighter. Thus, the intermediate layer or moisture barrier 78, with the cuff member 82 of moisture barrier material, in effect extends completely along the sleeve of the garment 10 and along the arm portion of the firefighter and encompasses the wrist of the firefighter. There is no gap or space between the intermediate layer 78 and the cuff member 82. Thus, even though moisture may penetrate the outer shell 76, movement of moisture to the arm of the firefighter is prevented. The wristlet or seal member 92, which tightly encompasses the cuff member 82, prevents movement of debris or embers or the like into the sleeve portion of the garment 10. The wristlet or seal member 94, which tightly encompasses the wrist of the firefighter, prevents movement of debris and embers and the like into engagement with the wrist and arm of the firefighter. Thus, the wrist and arm of the firefighter are effectively protected against movement of water and debris into the sleeve of the garment and/or into engagement with the wrist and arm of the firefighter.

FIG. 5 illustrates shows the outer layer 76 separated from the other layers. The snaps 90 and 88 are disengaged, and the outer layer 76 can be separated from the other layers 78 and 80 as illustrated by an arrow 99. If complete removal of the outer layer 76 is not desired, detachment of the outer layer 76 from the other layers adjacent the cuff member 82 permits the outer layer 76 to be folded or rolled backwardly for drying the inner layer 80.

Although the preferred embodiment of the firefighter's garment of this invention has been described, it will be understood that within the purview of this invention various changes may be made in the form, details, proportion and arrangement of parts, the combination of parts, and the manner of use, which generally stated consist in a firefighter's coat within the scope of the appended claims.

The invention having thus been described, the following is claimed:

1. A firefighter's garment comprising a sleeve having a given length, the sleeve including an outer layer of flame resistant material, an intermediate layer of moisture barrier material and an inner layer of thermal barrier material, each of the layers extending substantially the length of the sleeve, a cuff member of moisture barrier material, means attaching the cuff member to the intermediate layer whereby the cuff member extends from the intermediate layer, the cuff member having an outer surface, the outer layer having an inner surface, a first flexible annular seal member, the first flexible annular seal member being positioned between the surfaces, means attaching the first flexible annular seal member to one of the surfaces as the first flexible annular seal member engages the other surface, a second flexible annular seal member, the second flexible annular seal member being encompassed by the cuff member, and means connecting the second flexible annular seal member to the cuff member, whereby the cuff member and the second flexible annular seal member are adapted to engage the wrist of a firefighter who wears the garment and whereby the cuff member and the flexible annular seal members prevent fluids and debris from travel to the wrist and arm of the firefighter who wears the garment.

2. The firefighter's garment of claim 1 in which the first flexible annular seal member is attached to the inner surface of the outer layer.

3. The firefighter's garment of claim 1 which includes means connecting the outer layer to the intermediate layer.

4. The firefighter's garment of claim 1 which includes means releasably connecting the outer layer to the intermediate layer.

5. The firefighter's garment of claim 1 in which the first flexible annular seal member is of thermal barrier material.

6. The firefighter's garment of claim 1 in which the second flexible annular seal member is of thermal barrier material.

7. The firefighter's garment of claim 1 in which the first flexible annular seal member is of thermal barrier material and the second flexible annular seal member is of thermal barrier material.

8. The firefighter's garment of claim 1 which includes a plurality of tab members releasably attaching the outer layer to the intermediate layer.

9. The firefighter's garment of claim 1 in which the means attaching the cuff member to the intermediate layer comprises stitching means.

10. The firefighter's garment of claim 1 in which the cuff member is secured directly to the intermediate layer.

11. A firefighter's coat of the type provided with a pair of arm length sleeve members, each of the sleeve members having a plurality of layers, there being a first layer and a second layer, the first layer encompassing the second layer, each of the layers of the sleeve members having an extremity portion, the combination comprising a cuff member joined to the extremity portion of the second layer and extending therefrom, a first flexible annular seal member, the first flexible annular seal member being positioned between the first layer and the cuff member, a second flexible annular seal member, means attaching the second flexible annular seal member to the cuff member, the second flexible annular seal member being encompassed by the cuff member, the second flexible annular seal member being adapted to encompass and to engage the wrist of a person wearing the firefighter's coat, the cuff member also being adapted to encompass and engage the wrist of a firefighter wearing the firefighter's coat.

12. The firefighter's coat of claim 11 in which the first layer is a flame resistant layer and the second layer is a moisture barrier layer.

13. The firefighter's coat of claim 11 in which the cuff member is of moisture barrier material.

14. The firefighter's coat of claim 11 in which the first flexible seal member is attached to the first layer and engages the second layer.

15. The firefighter's coat of claim 11 in which the first flexible annular seal member is attached to the first layer.

16. A firefighter's coat which is provided with a sleeve member, the sleeve member comprising a plurality of layers, one of the layers including a cuff-like extension portion, one of the layers including an extension portion which comprises a flexible annular seal member which is encompassed by the cuff member, the flexible annular seal member being adapted to engage the wrist of the firefighter who wears the coat, and one of the layers including an extension portion which comprises a flexible annular seal member which encompasses and engages the cuff member.

17. The firefighter's coat of claim 16 in which the cuff member is of moisture barrier material.

18. The firefighter's coat of claim 16 in which the annular seal members are of thermal barrier material.

19. The firefighter's coat of claim 16 in which the layer which includes a cuff-like extension is a layer of moisture barrier material.

20. The firefighter's coat of claim 16 in which one of the layers which includes an extension portion which comprises a flexible annular seal member is a layer of flame resistant material.

21. The firefighter's coat of claim 16 in which one of the layers which includes an extension portion which comprises a flexible annular seal member is a layer of thermal barrier material.

22. A firefighter's garment of the type provided with a pair of sleeve members, each of the sleeve members having a plurality of layers, there being a first layer and a second layer, each of the layers having an extremity portion, the combination comprising a first annular seal member, an annular cuff member extending from the extremity portion of one of the layers, the first annular seal member being positioned between the other layer and the cuff member, a second annular seal member, the second annular seal member being encompassed by the cuff member, and means attaching each of the seal members to one of the layers.

23. The firefighter's garment of claim 22 in which at least one of the seal members is of thermal barrier material.

24. The firefighter's garment of claim 22 in which the cuff member is of moisture barrier material.

25. The firefighter's garment of claim 22 in which the cuff member and the layer from which the cuff member extends are of moisture barrier material.

26. The firefighter's garment of claim 22 in which one of the layers is of thermal barrier material.

27. The firefighter's garment of claim 22 in which the cuff member is of moisture barrier material and each of the annular seal members is of thermal barrier material.

* * * * *